United States Patent [19]

Bangerter

[11] Patent Number: 4,473,060

[45] Date of Patent: Sep. 25, 1984

[54] ENERGY EFFICIENT HEATING SYSTEM

[76] Inventor: Robert A. Bangerter, Box 320, Overgaard, Ariz. 85933

[21] Appl. No.: 455,657

[22] Filed: Jan. 5, 1983

[51] Int. Cl.[3] ..... F24D 9/00

[52] U.S. Cl. ..... 126/101; 237/50; 237/19; 34/90

[58] Field of Search ..... 237/50, 51, 55, 52, 237/53, 56; 165/DIG. 2, DIG. 12; 34/90; 126/110 E, 110 AA, 112, 99 R, 101

[56] References Cited

U.S. PATENT DOCUMENTS 3,999,710 12/1976 Kemmerer ..... 237/53
4,194,688 3/1980 Cobos ..... 237/53
4,320,739 3/1982 Wilhoite ..... 237/52
4,343,290 8/1982 Flatte ..... 126/110 E

*Primary Examiner*—Albert J. Makay
*Assistant Examiner*—Henry Bennett
*Attorney, Agent, or Firm*—Mybeck Richard R.

[57] ABSTRACT

An energy efficient heating system for utilizing non-petroleum based fuels capable of obtained incremetalized burn rates and fully automated control whereupon the beneficial utilization of heat produced thereby is maximized and the waste of heat is significantly reduced. System especially adapted for heating living areas such as mobile homes and operating heat-needy appliances and functions located therein.

9 Claims, 3 Drawing Figures

ENERGY EFFICIENT HEATING SYSTEM

BACKGROUND OF THE INVENTION

This invention relates generally to a heating unit and more particularly to a highly efficient heating unit fired with relatively inexpensive non-petroleum based fuels which is capable of capturing substantially all of the heat produced by combustion of such fuel and directing it in a preselective manner to heat water, dry clothes, heat human habitats or heat pumps for storage as dictated by the exigencies of the moment.

Of course, the concept of utilizing a fire chamber through which pass water pipes disposed in closed circuit with strategically disposed radiators and the like to heat homes and buildings is well known as demonstrated by so-called "hot water" and "steam" heating systems. Further, fuel combustion has been previously used to heat air which in turn was transported through a home or office building in so called "forced-air" heating systems.

However, most of these systems with but few exceptions which will be discussed later, required the use of petroleum based fuels such as coal, fuel oil, charcoal, natural gas and the like which since the advent of the OPEC conspiracy has raised the cost of home heating and heat-needy home conveniences beyond the means of many who are on fixed incomes and all who are unemployed thus posing a serious health hazard to many people.

Those heating units which do not employ petroleum based fuels, that is, wood burning units suffered from the fact that many of the features desired for a home heating unit could not be obtained with wood burners because of the undesirable by-products inherently present in the combustion by-products of a wood fire. One major problem of a wood fire is the creation and accumulation of creosote and tars which inherently result from the burning of wood. These substances not only contaminate the environment into which they are expelled, they create adverse physiological reactions from humans who enter that environment. Further, the toxic and irritating nature of such by-products, when less than perfect combustion is obtained, has heretofore required the use of strong updrafts to force such combustion by-products up a flue and into the neighborhood atmosphere where, absent an inversion, it is diluted into an environment so that it can be tolerated. However such a system inevitably wasted a substantial amount of the heat generated by the fire. The useful vs. wasted heat ratio of such systems restricted their installation primarily to esthetic locations because the fuel efficiency was wasteful.

Nor were such systems, because of the smoky odors they generate, ever deemed useful for the drying of clothes or like operations because while society readily accepts a smoked odor in its hams and sausages, it rejects such an odor as offensive when associated with people and their clothing.

The present invention thus is directed to a heating unit which readily, indeed preferrably, uses wood as its fuel and which by the very nature of its structural interrelationship allows the heat combustion produced therefrom to be readily employed to provide hot water, dry clothes (in an odor free fashion) and warm the human environment without any of the unpleasantness or inefficiencies heretofore associated with and generally considered as unavoidable side-effects of wood burning furnaces and fireplaces. The unit is especially suited for though not limited to installation for heating mobile homes.

BRIEF SUMMARY OF INVENTION

Briefly the present invention comprises a heating unit having a fire box totally surrounded by an outer chamber through which the flow of fresh air is forced and from which the heated air is selectively directed to ducts interconnecting the heat flow to the several rooms and areas of the building where human comfort and necessity requires heat, to a clothes dryer, and to any other situs where human need or comfort is maintained or enhanced by readily available heated air. Concurrently with the transfer of the heat of combustion from the burning wood through the inner chamber wall to the air flowing though the chamber, a plurality of pipes, superposed to the fire grate upon which the wood combustion occurs, are provided with a continuing liquid flow which flow, when heated to the temperature desired for human activity, is transmitted to a water supply which accepts the transfer of heat therefrom and is thereafter directed to appropriate storage tanks or outlets where laundry, dish washing showering, bathing and like endeavors occur.

OBJECTS OF THE INVENTION

The primary object of the present invention is to provide a non-petroleum based fuel fired heating unit which overcomes the problems heretofore inherent in wood-burning units while permitting the generation of a contaminant free supply of warm air and hot water to the building in which it is installed while avoiding the inefficiencies, the irritation and the dirt heretofore recognized and generally accepted as necessary companions to the use of wood burning units.

It is a further object of the present invention to provide a relatively inexpensive heat source for those people who can no longer afford to heat their homes, dry their clothes or heat their water and the like with systems which require the purchase of energy which is comprised of or is derived from petroleum based fuels.

Still another object of the present invention is to provide a full automated result-response heating system in which multiple-stage controls enable the substantially complete utilization of the heat generated in the fire box is a safe and efficient manner without polluting the surrounding environment or significantly depriving needed oxygen from the human quarters associated therewith.

These and still further object as shall hereinafter appear are readily fulfilled by the present invention in a remarkably unexpected fashion as may discerned from the following detailed description of an exemplary embodiment thereof especially when read in conjunction with the accompanying drawing in which like numbers identify like parts throughout the several views.

THE DRAWING

DESCRIPTION OF PREFERRED EMBODIMENT

Figure 1:
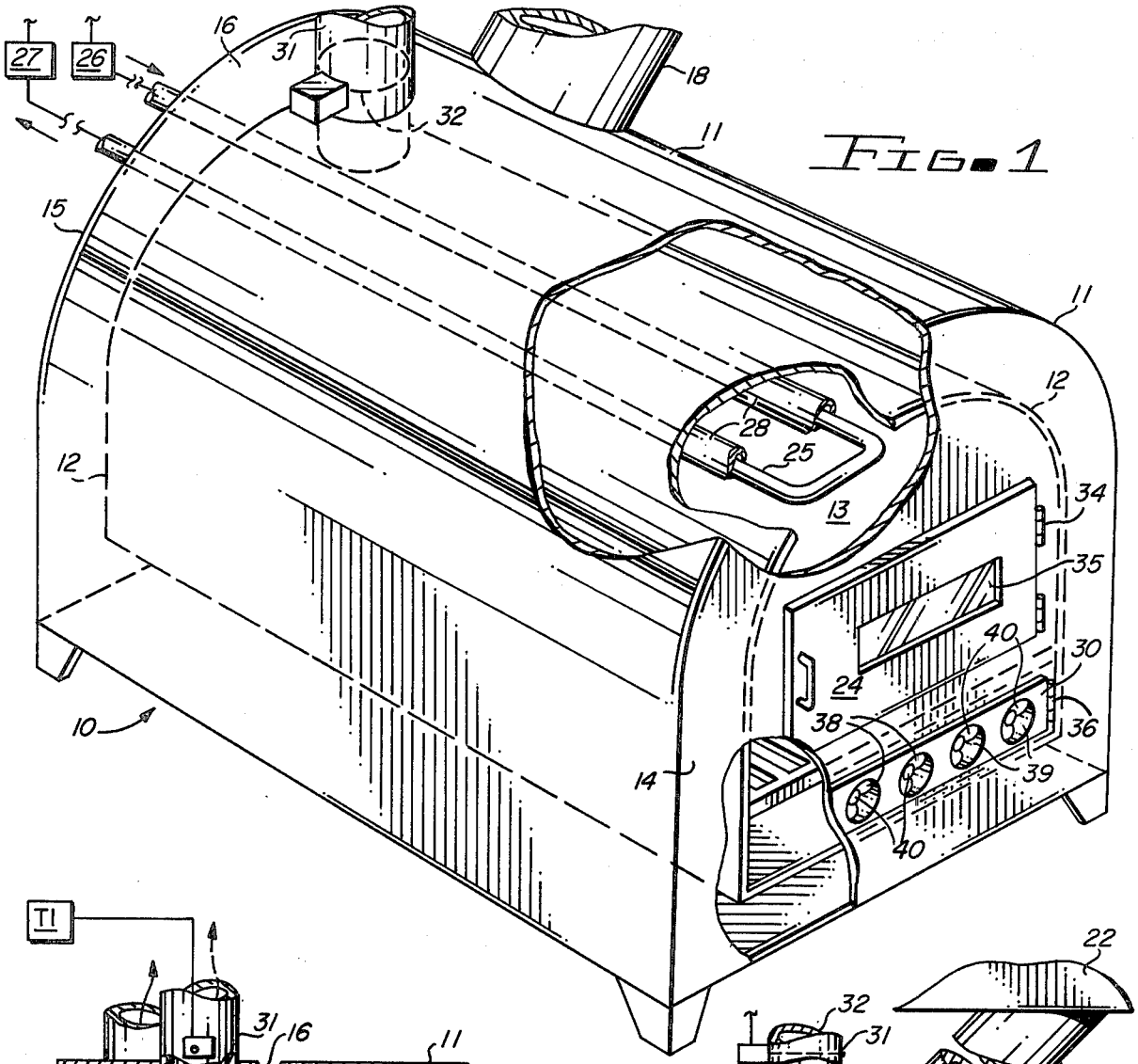
FIG. 1 is a three quarter isometric view of a heating unit embodying the present invention.
Figure 2:
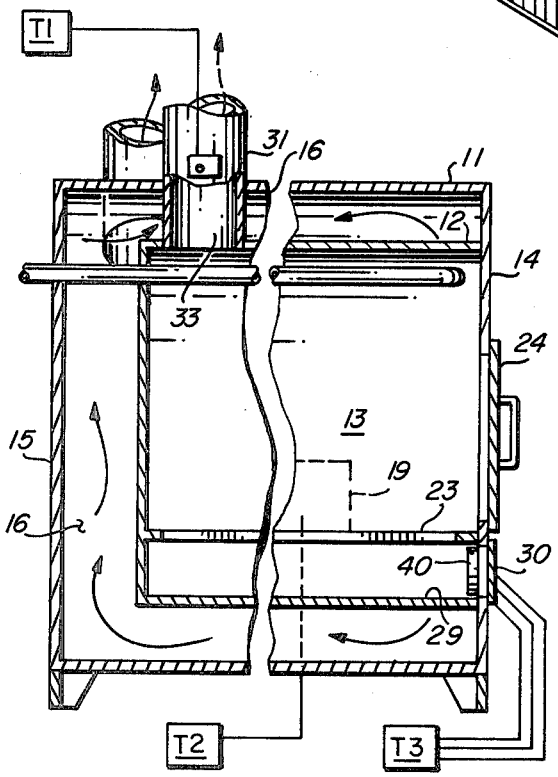
FIG. 2 is a side section, partially broken away, of the unit of FIG. 1.
Figure 3:
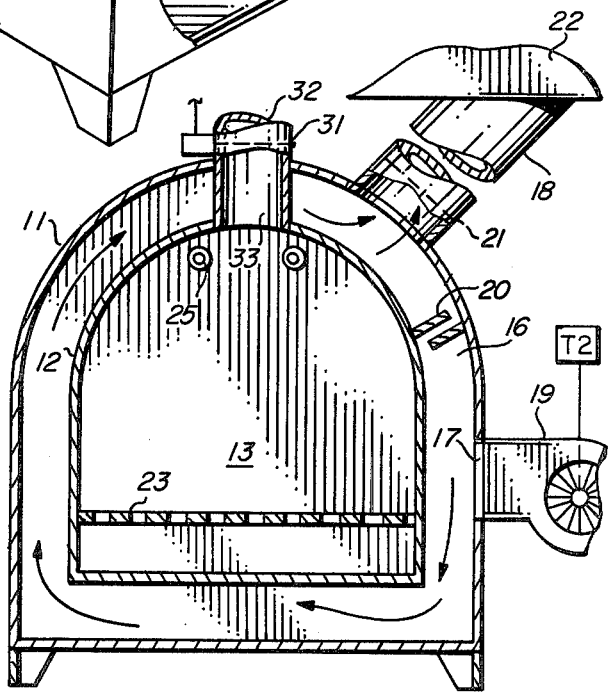
FIG. 3 is a front elevation partially in section of the unit of FIG. 1.

Referring to FIG. 1, reference number 10 generally designates my heating unit. The heating unit 10 comprises an outer shell 11, an inner shell 12, and a fire box 13. Outer shell 11 and inner shell 12 cooperate with front plate 14 and rear plate 15 to define air chamber 16 having an inlet 17 and one or more outlets 18.

Disposed in operative association with and adjacent to inlet 17 is a fan 19 which draws air from the surrounding environment and forces it into air chamber 16. Suitable baffles 20 are disposed in chamber 16 between the inlet 17 and outlet 18 to prevent the air to flow from short circuiting itself without proper heating. A thermostatically controlled damper 21 is disposed adjacent outlet 18 to control the passage of heated air out of chamber 16 into distribution pipe 22.

Referring to fire box 13, located near the bottom thereof but sufficiently raised to permit the ready accumulation therebeneath and the removal of ashes therefrom is a plurality of grates 23 upon which the wood fuel (not shown) is suitably stoked through fire door 24. In superposition to the grates 23 is a plurality of pipes 25 through which water is flowed to receive heat from the burining wood, having originated at water source 26 and being ultimately directed, when heated to the desired temperature, to a storage tank 27 or other appliance such as diswasher, clothes washer, shower, tub and the like for use. In areas in which the water supply contains high mineral content, pipes 25 will be circumscribed by an outer pipe 28, disposed concentrically thereto and filled with a high boiling point non-corrosive heat exchange medium such as DOWTHERM TM which will prevent so-called "hot spots" in the water line by equalizing the heat distribution thereto and thereby avoid mineral build-up and the maintenance problems caused thereby.

Beneath grates 23 is disposed a suitable ash collector 29 from which the ashes dropping thereupon from grate 23 can be quickly and readily removed through draft door 30 using a shovel or other suitable means.

Located at the top of the firebox 13 remote from the combustion air intake, hereinafter described, is flue 31 for discharging the combusted gases and by products from fire box 13 through flue mouth 33. A damper 32 is disposed in operative association in 31 above mouth 33 to control the passage of combustion products from fire box 13 and out flue 31.

Fire door 24 is mounted to front plate 14 by hinges 34 and may be provided with a thermal resistant glass panel 35 to allow the tender to inspect the fire without opening fire door 24. Fire door 24 when open provides ingress to fire box 13 for stoking fuel.

Draft door 30 is disposed in and mounted to front plate 14 by hinges 36 below firedoor 24 and in registry with ash collector tray 29 whereupon ash collector 29 can be readily withdrawn for emptying and cleaning when required.

When appropriate, a conduit may be provided in heat transferable relationship to flue 31 to preheat air directed to inlet 17 and further enhance the efficiency of my system.

In draft door 30 are disposed a plurality of combustion air intake valves which in my preferred embodiment are operated in pairs and which for ease of description I will call center pair 38 and right pair 39 (relative to the orientation of FIG. 4). A left pair is not shown because of the breakaway view. The regulation of the flow of air through these valves to provide a preselected amount of oxygen to support the combustion in firebox 13 including the selective activation of biscuit fans 40 will be described hereafter in connection with the remote control of my unit.

In addition to the thermostat described for controlling the movement of the damper associated with and hence the flow of heated air through outlet 18, additional thermostats T1 and T2 are provided in the living area which, in response to limits defined to suit the individual needs or preferences of the occupants will regulate the relative opening and closing of damper 32 (T1) and control the operation of fan 17 to regulate the flow of fresh (or preheated as described above) air into chamber 16. The cooperative interaction of the thermostat associated with outlet 18 and thermostat T2, enables the flow of air into and out of air chamber 16 to be readily controllable.

A third thermostat T3 is provided to coact with air inlet valves 38, 39 in a multi-stage operation, that is, when conditions demand, the first stage will effect the opening or closing of valves 38 to effect either more rapid or slower fuel combustion whereas the second stage will similarly effect the opening or closing of valves 39 and a third stage will effect the opening and closing of the remaining valve set (not shown). In this fashion I overcome one of the more serious drawbacks to wood-fueled heating unit, that is, it is either "too hot" or "too cold". My multi-stage thermostat T3 enables me to achieve precise incremental control of combustion air intake thereby allowing me to incrementalize the rate of combustion within fire box 13 and ultimately the useful heat produced thereby.

In addition to the advantages already illustrated and described, the present invention avoids the use of petroleum-based fuels by relying on wood which is readily available in abundant supply throughout our national forests and can be acquired by expending effort to collect it. Further, the present invention provides a ready means to dispose in a useful fashion the many accumulated branches, twigs and trees annually collected in connection with reforestation.

From the foregoing, it is readily apparent that all of the foregoing objectives have been fulfilled by the present invention in a remarkably unexpected fashion. Of course it is understood that such modifications, alterations and adaptations as may readily occur to the artisan, familar with the art to which this invention pertains, are intended within the spirit of the present invention which is limited only by the scope of the claims appended hereto.

Accordingly, what is claimed is:

1. An energy efficient heating system comprising a front plate; a rear plate disposed in spaced substantially parallel relationship to said front plate; an inner shell interposed between said front plate and said rear plate and coacting therewith to define a fire box therebetween; an outer shell interposed between said front plate and said rear plate in spaced relationship to said inner shell and coacting therewith to define an enclosed air chamber thereabout; a plurality of grates operatively disposed in said fire box; means for feeding non-petroleum based fuel onto said grates for combustion thereupon; first control means for selectively directing air into said fire box; means for feeding non-petroleum based fuel onto said grates for combustion thereupon: first control means for selectively regulating the ingress of ambient air into and the egress of heated air from said air chamber; flue means for directing unwanted combustion by-products out of said fire box; a plurality of water pipes disposed in said fire box in superposition to said grates and in heat receptive relationship to said combustion; an outer pipe circumscribing each of said water pipes in concentric spaced relationship thereto defining an annulus therebetween, said annulus containing a high boiling non-corrosive heat transfer medium; duct means directing heated air from said air chamber to preselected locations and appliances; and conduit means directing heated water from said water pipes to preselected destination.

2. A heating system according to claim 1 in which said front plate comprises a body portion, a first opening and a second opening defined in said body portion, said second opening being juxtaposed relative to said first opening.

3. A heating system according to claim 2 in which said first opening is selectively closeable by a pivotable draft door and said second opening is selectively closeable by a pivotable fire door.

4. A heating system according to claim 3 in which said draft door contains a plurality of selectively adjustable air vents disposed in axial alignment with each other along the transverse median of said door.

5. A heating system according to claim 4 in which said first control means operatively adjusts said selectively adjustable air vents sequentially between an open and a closed position in response to a signal transmitted thereto from a sending device disposed remotely therefrom to incrementalize said combustion air input and the heat of combustion resulting therefrom.

6. A heating system according to claim 1 in which a blower is operatively disposed at the mouth of said air chamber, said blower being selectively operable in response to said second control means which reacts to a signal transmitted thereto from a sending device disposed remotely therefrom and a plurality of baffle members is operatively interposed in said air chamber intermediate said ingress and said egress to disrupt the flow of air directly therebetween.

7. A heating system according to claim 6 in which heat carried by said unwanted combusiton by-products is selectively transferred to said ambient air before said ambient air enters said air chamber.

8. A heating system according to claim 1 in which a tray is disposed in said fire box beneath said grates to collect and facilitate the removal of ash from said fire box.

9. A heating system according to claim 1 comprising a clothes dryer, duct means operatively interposed between said air chamber and said clothes dryer, and means directing heated air from said air chamber through said duct means into said clothes dryer as the sole source of heat therefor.

* * * * *